US010034556B2

(12) United States Patent
Lamkin

(10) Patent No.: US 10,034,556 B2
(45) Date of Patent: Jul. 31, 2018

(54) BABY SEAT SACK APPARATUS AND METHOD

(71) Applicant: Laura Marie Lamkin, Fairview, TX (US)

(72) Inventor: Laura Marie Lamkin, Fairview, TX (US)

( * ) Notice: Subject to any disclaimer, the term of this patent is extended or adjusted under 35 U.S.C. 154(b) by 0 days.

(21) Appl. No.: 15/051,933

(22) Filed: Feb. 24, 2016

(65) Prior Publication Data

US 2016/0242568 A1 Aug. 25, 2016

Related U.S. Application Data

(60) Provisional application No. 62/119,813, filed on Feb. 24, 2015.

(51) Int. Cl.
*A47D 15/00* (2006.01)

(52) U.S. Cl.
CPC ..... *A47D 15/006* (2013.01)

(58) Field of Classification Search
CPC ..... A47D 15/006; A47C 31/11; B60N 2/60; B60N 2/6063
See application file for complete search history.

(56) References Cited

U.S. PATENT DOCUMENTS

D300,784 S * 4/1989 Powers ..... D3/233
5,806,925 A * 9/1998 Hanley ..... A47C 31/113 297/219.1
5,988,742 A * 11/1999 Stevens ..... A47D 15/006 297/219.12
6,224,152 B1 * 5/2001 Hughes ..... A47D 15/006 297/219.12
6,749,258 B1 * 6/2004 Leikin ..... A47D 13/02 297/219.12
D648,588 S * 11/2011 Rice Golin ..... D6/611
8,118,364 B2 * 2/2012 Davis ..... A47D 15/006 128/869
D691,835 S * 10/2013 Tyler ..... D6/611
D696,053 S * 12/2013 Lang ..... D6/715
9,049,946 B1 * 6/2015 Tyler ..... A47D 15/00
9,095,220 B1 * 8/2015 Castle ..... B60N 2/2839
9,555,823 B2 * 1/2017 Dehmer ..... B60N 2/28
2004/0217633 A1 * 11/2004 Kassai ..... A47D 15/006 297/219.12
2011/0012404 A1 * 1/2011 Cariera ..... A47D 1/00 297/219.12
2013/0270876 A1 * 10/2013 Skarvan ..... B62J 1/20 297/195.11
2016/0073798 A1 * 3/2016 Pawlikowski ..... A47G 9/0246 5/497

* cited by examiner

*Primary Examiner* — Philip F Gabler
(74) *Attorney, Agent, or Firm* — Billion & Armitage; Richard E. Billion

(57) ABSTRACT

The present invention includes an adjustable pocket that stretches to accommodate many types of seats. The invention is sized to fit over seats associated with infant swings, bouncers, carriers, strollers and the like. The adjustable pocket includes a mechanism for securely holding an infant in the seat and eliminates the inconvenience of various seat straps.

20 Claims, 7 Drawing Sheets

BABY SEAT SACK APPARATUS AND METHOD

TECHNICAL FIELD

Various embodiments described herein relate to an apparatus for a baby seat sack and to a method of making and using the same.

BACKGROUND

Many types of baby seats are available on the market. For example, there are seats for a swing, a cradle, a stroller, a carrying device, and the like. Infants sleep often. Many times it is desired to remove a sleeping baby from a seat. This requires undoing loads of fasteners in very dose proximity to the infant. In many instances, the infant awakes and the caretaker has to rock or otherwise soothe the infant back to sleep. In many instances, the straps are ignored so that the infant, once asleep, can be easily transferred from the seat to a sleeping area, such as a crib.

In addition, it is also desirable to make an infant seat more. Increased comfort translates into more uninterrupted sleep. It is also desireable to provide the increased comfort while keeping the infant safe within the seat.

Of course, in some applications, straps are necessary. For example, a car seat needs to have straps and the straps need to be used for the safety of the infant.

SUMMARY OF THE INVENTION

The present invention includes an adjustable pocket that stretches to accommodate many types of seats. The invention is sized to fit over seats associated with infant swings, bouncers, carriers, strollers and the like. The adjustable pocket includes a mechanism for securely holding an infant in the seat and eliminates the inconvenience of various seat straps. In this way, the caretaker can more easily remove the infant from a seat and transfer the infant to a crib, cradle or the like without having the infant become fully awake.

BRIEF DESCRIPTION OF THE DRAWINGS

The embodiments will be readily understood by the following detailed description in conjunction with the accompanying drawings, wherein like reference numerals designate like structural elements, and in which.

DETAILED DESCRIPTION

In the following paper, numerous specific details are set forth to provide a thorough understanding of the concepts underlying the described embodiments. It will be apparent, however, to one skilled in the art that the described embodiments may be practiced without some or all of these specific details. In other instances, well known process steps have not been described in detail in order to avoid unnecessarily obscuring the underlying concepts.

Figure 1:
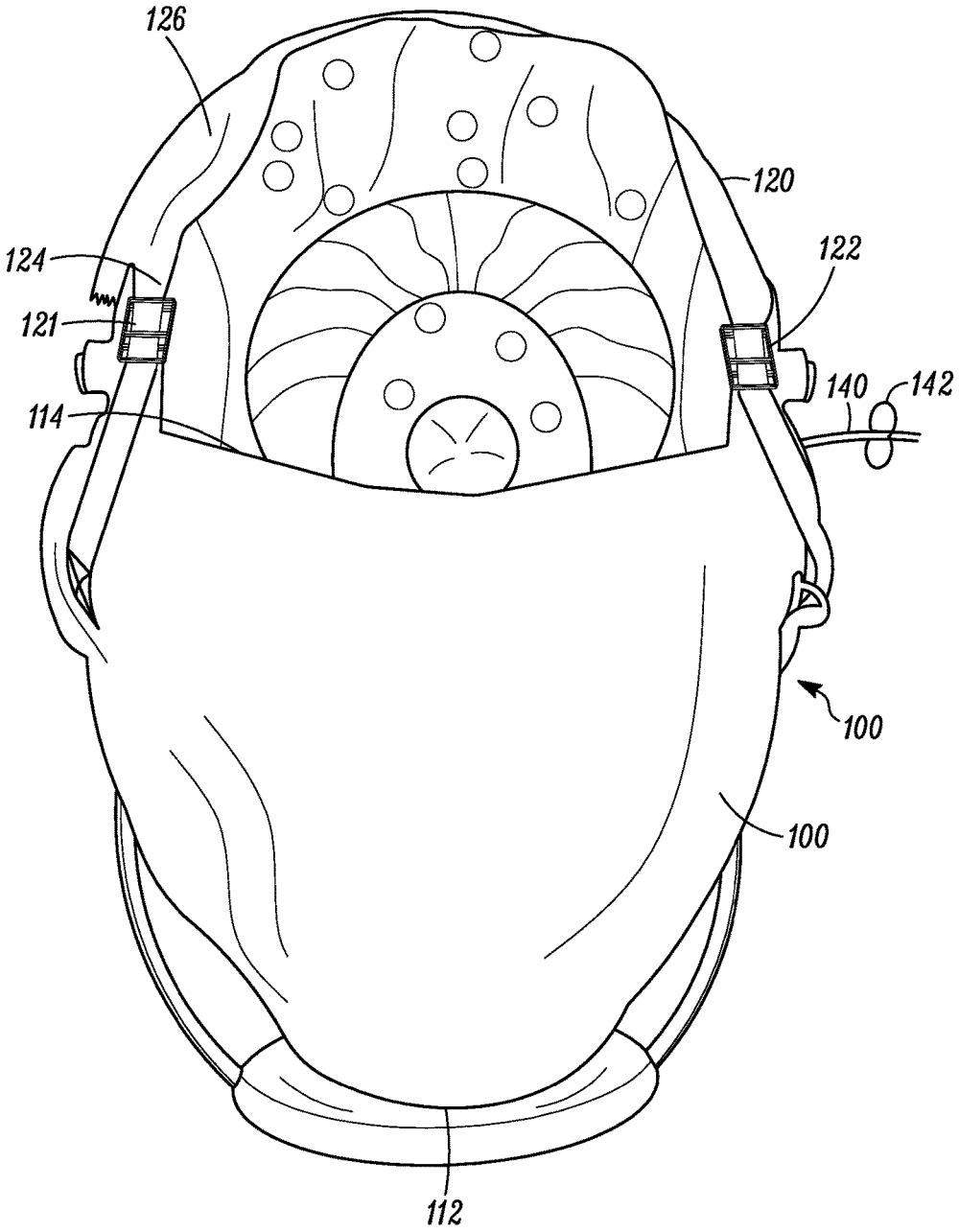
FIG. 1 is a front view of a baby seat sack apparatus, according to an example embodiment.

FIG. 1 is a front view of a baby seat sack apparatus 100, according to an example embodiment. The seat sack apparatus 100 includes a sack 110 sized to fit over one end of a seat apparatus and a reinforcement strap 120 attached to the sack 110. The sack 110 includes a closed end 112, an open end 114 sized to receive the one end of a seat. The sack 110 also includes a draw cord 140 positioned around the open end 114 of the sack, and a cord lock 142 for holding the draw cord 140 in a drawn position or tightened state. In one embodiment, the open end 114 is finished by folding over the material at the open end 114 of the sack 110. A button hole can be formed near the edge and near the seam where a bottom portion of the sack 110 meets the top portion of the sack 110. The button hole is sized and placed away from the edge so that upon finishing the open end 114, the button hole is presented near or at the finished edge of the open end 114. The material is folded at least once. In some embodiments, the raw edge is folded twice so that the edge within the sack 110 has a neat appearance. The hem allowance is provided so that the drawstring or cord 140 can be threaded through the button hole or otherwise finished opening. The drawstring or cord 140 has sufficient length to allow the open end 114 to open a maximum distance with at least two ends extending from the button hole or other opening. The length of the two ends is not overly long. The length of the two cord 140 ends is selected so that they will be safe even if one should wind up in the sack 100. The cord lock 142 is then placed over the two lengths of cord and the two lengths of cord can be knotted or otherwise upset to prevent the cord lock 1142 from coming off the end when the drawstring or cord is loosened.

The cord lock 142 prevents the cord 140 from loosening once the cord 140 is tightened at or near the open end 114. The reinforcement strap 120 fits over a portion of the other end of the seat apparatus. More specifically, the reinforcement strap 120 fits around the outer portion of the top portion of the seat frame which remains open after the sack 100 has been placed over the foot end of the seat of an apparatus. The reinforcement strap 120 includes at least one buckle 121. In the embodiment shown, the reinforcement strap 120 includes a first buckle 121 and a second buckle 122. The reinforcement strap 120 is adjustable to a position where the reinforcement strap 120 substantially prevents movement of the seat sack apparatus 100 with respect to a frame of the seat. As shown, the reinforcement strap 120 includes a length of polyester or nylon webbing material 124. One of the buckles 121 is attached to one end of the polyester or nylon webbing material 124. The other buckle 122 is sewn to the other end of the polyester or nylon webbing material 124. As shown, the non adjustable end of each buckle 121, 122 is sewn to the reinforcement strap 120. An end of the reinforcement strap is threaded through a slit shaped opening in the buckle and then doubled over on itself and stitched into place. In this way, the reinforcement strap has a fixed length and the adjustable ends are pointed away from the reinforcement strap 120. In this way, the ends of other portions of nylon or polyester webbing material point away from the reinforcement strap 120. This is for the safety and comfort of the infant. The free ends of any webbing will drape down along the sides of the sack apparatus 100.

The reinforcement strap 120 also includes a widened portion 126 which is located between the two ends of the reinforcement strap 120. The widened portion 126 grips more of the frame of the seat to which the sack apparatus 100 is attached. The widened portion 126, in one embodiment, can be provided with a gripping surface which grabs the frame of the seat to prevent movement of the seat frame or outer portion of the seat with respect to the reinforcement strap 120. The grip surface can be formed of an elastomeric material that is also safe for the infant. In another embodiment, the widened portion can be a rubber type material that has slits therein through which the nylon webbing 124 can be threaded.

The reinforcement strap, in one embodiment, also includes at least one formable stay to allow the strap to be formed to the frame of the seat. The stay can be formed so it includes a catch which catches the lip of the frame. In another embodiment, the stay runs parallel to the body of the frame. In still another embodiment, metal stays can be provided in the widened portion to grip the frame. For example, many frames have bottom edges that could hold an L-shaped metal stay in tension when tightened by catching the bottom lip of the frame. In still another embodiment, the reinforcement strap 120 is provided with metal stays that are shaped to conform to the outer edge of the seat frame. In this way, the metal stays allow the user to reposition the reinforcement strap to approximately the same position associated with a previous use.

The at least one buckle fastener 121, 122 can be any type of buckle. In one embodiment, the buckle can be a parachute buckle fastener. The parachute type fastener allows for a quick release of the sack 110 from the reinforcement strap 120. Two sides of a parachute fastener are pressed inwardly to release one portion of the parachute buckle from the other. When engaging the parachute buckle, the two ends click into place providing an audible indication that the buckle is engaged. The nylon webbing or nylon strap is cinched tightly. The reinforcement strap 120 substantially prevents movement of the seat sack apparatus 100 with respect to a frame of the seat. The sack 110, in one embodiment, is made of material which is stretchable in a first direction and substantially unstretchable in a second direction which is substantially perpendicular to the first direction. The sack 100 is formed so that the material is oriented so the stretchable direction is substantially parallel to the open end of the sack. Put another way, the bias direction of the fabric forming the sack 110 is substantially parallel 114 to the open end of the sack 110. This is for the safety of the infant since the non bias direction is substantially perpendicular to the open end 114 of the sack 110. Since the amount of stretch is limited in the direction the infant would "slip down" the sack 110 holds the baby onto the seat, provided that the reinforcement strap 120 has also been tightened to substantially prevent motion between the seat sack apparatus 100 and the frame of the seat.

In one embodiment, a twill fabric is used to form the sack 110. The twill stretches in a direction substantially parallel to the open end 114 of the sack 110. The twill has a very limited amount of stretch perpendicular to the open end 114 of the sack 110. This also means the amount of stretch along the length of the seat for the infant is limited. It should be noted that the bias or stretch direction of the fabric needs to be carefully selected so as to limit the possible motion of the infant with respect to the sack 110. Once the bias or direction of stretch for the fabric of the sack 110 has been set, the sack 110 is the main fabric support. The sack 110 can be lined with softer or warmer materials such as a faux lamb's wool or polar fleece type fabric. This forms a warmer environment for an infant. In some instances, other fabrics can be used. For example, cotton or thin polyester blended fabrics will not trap the heat and may be more suitable for warmer climates. In tropic climates the main part of the sack can include vents to keep the infant cool.

Figure 2:
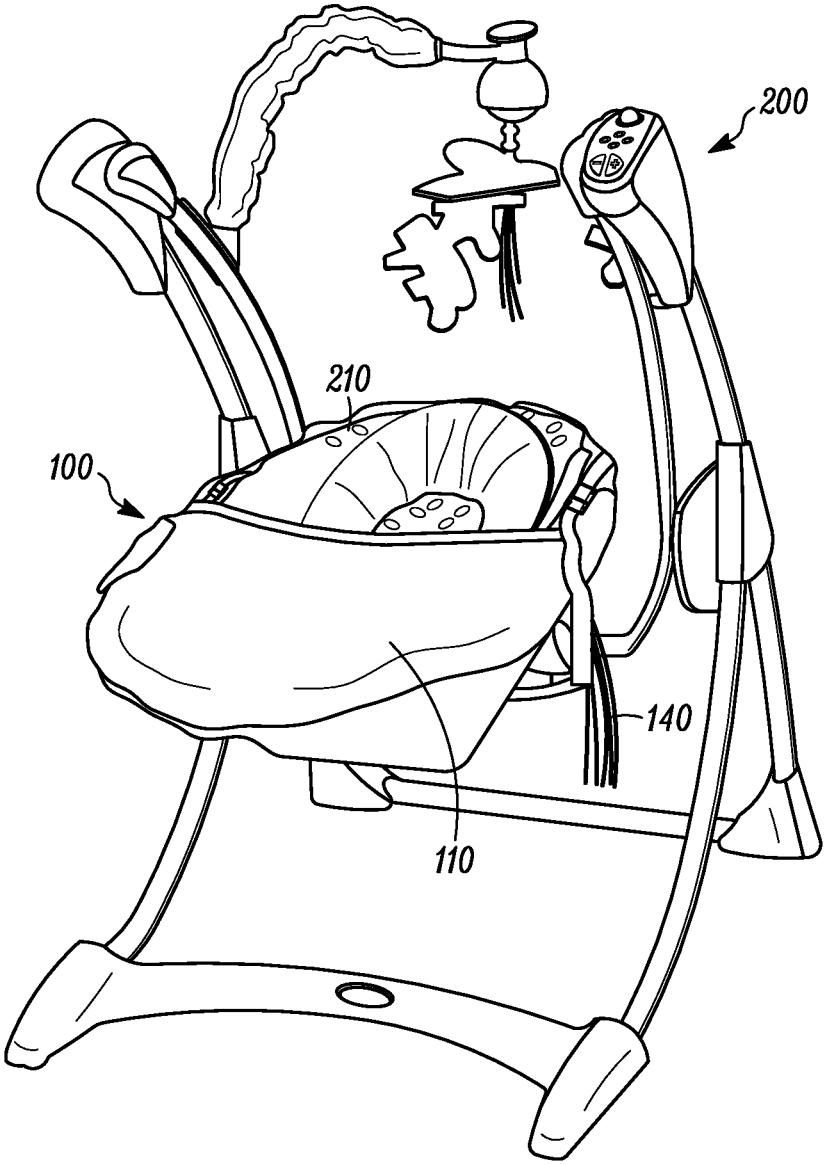
FIG. 2 is a front side view of a baby seat sack apparatus positioned on a seat of a swing, according to another example embodiment.

FIG. 2 is a front side view of a baby seat sack apparatus 100 positioned on a seat 210 of a swing 200, according to another example embodiment. The baby seat sack apparatus 100 can be easily adapted to fit different sized seats for different devices. The baby seat sack apparatus 100 is fitted to the new seat, such as the seat 210 for the swing 200. The drawstring is loosened. The sack 100 is fit over the foot end of the seat 210. The baby seat sack apparatus 100 is pulled over the foot end of the seat 210. The drawstring or cord 140 is drawn about the open end of the sack 110, or in a channel sewn into the sack 110 near the open end. The drawstring or cord 140 is drawn about the seat around a portion of the seat between the foot end and the head end of the seat until tight. The cord lock 142 is used to hold the drawstring or cord 140 tight so the sack 110 is held in place. The reinforcement strap 120 is attached to the sack 110. The nylon webbing strap material is pulled snug at the buckles 121, 122. The reinforcement strap 120 holds the sack in position with respect to the seat 210. Stays within the reinforcement strap 120 can be conformed to the seat 210 frame so that when the seat sack apparatus 100 is used again on the seat 210, installation will be eased. In one embodiment, the stays can include catches which catch features of the seat 210 frame and hold it in a relatively non movable position with respect to the baby seat sack apparatus 100.

Figure 3:
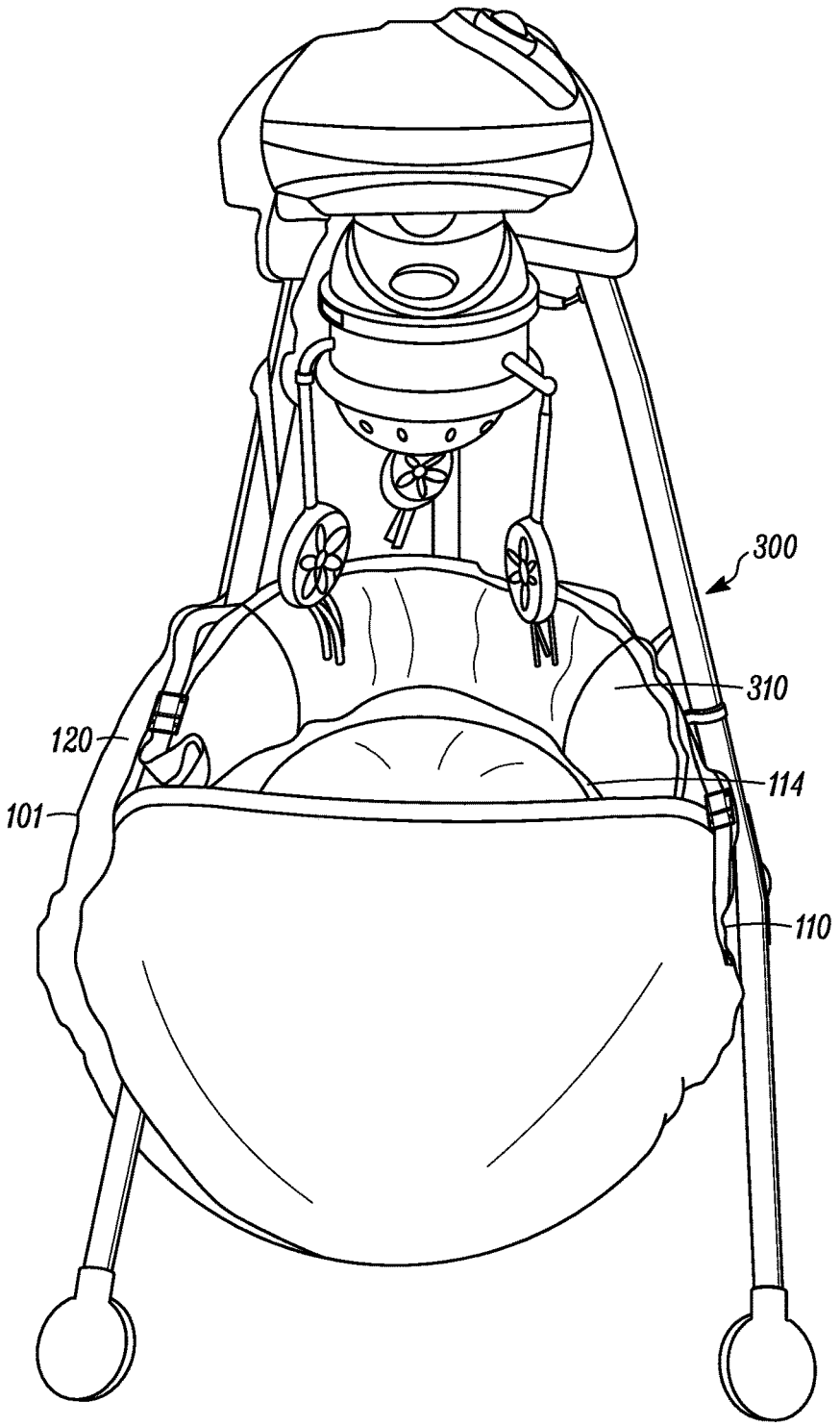
FIG. 3 is a perspective view of a baby seat sack apparatus positioned on a seat of another swing, according to another example embodiment.

FIG. 3 is a perspective view of a baby seat sack apparatus positioned on a seat of another swing 300, labeled as a cradle swing, according to another example embodiment. The baby seat sack 101 attaches or is positioned on the seat 310 in much the same way as discussed above. The procedure for fitting the baby seat sack apparatus 101 to the seat 310 is about the same. The baby seat sack 300 can be positioned on any number of seats, such as seat 210, 310, and others. The baby seat sack 100, 101 is versatile and flexible enough to fit most seats used by or for infants. The difference between the baby seat sack 100 and the baby seat sack 101, shown in FIG. 3, is that the drawstring has been eliminated in the baby seat sack apparatus 101. An elastomeric band is placed in a channel near or at the open end 114 of the sack 110. The elastomeric band can be a braided elastic which has a width of 0.25", an elastic waist band, elastic cording, or the like. Such items are available from Dritz Company which is owned by Prym Consumer USA Inc. of Spartanbrug, S.C., USA. Prym is Americas Notions and Crafts Company. Many of its brands, such as the Dritz brand, are available from craft stores and dry goods stores and other retailers. The elastic is enclosed and does not hang down. In this instance the open end 114 of the sack 110 of the baby seat sack 101 is opened. The elastic stretches. The open end is released and positioned along the length of the frame. When released, the open end grips the frame as it retracts. The elastic holds the open end 114 tight with respect to the frame of the seat 310. The reinforcement strap 120 is attached to the sack 110. The nylon webbing strap material is pulled snug at the buckles 121, 122. The reinforcement strap 120 holds the sack in position with respect to the seat 310. Stays within the reinforcement strap 120 can be conformed to the seat 310 frame so that when the seat sack apparatus 1001 is used again on the seat 310, installation will be eased.

Figure 4A:
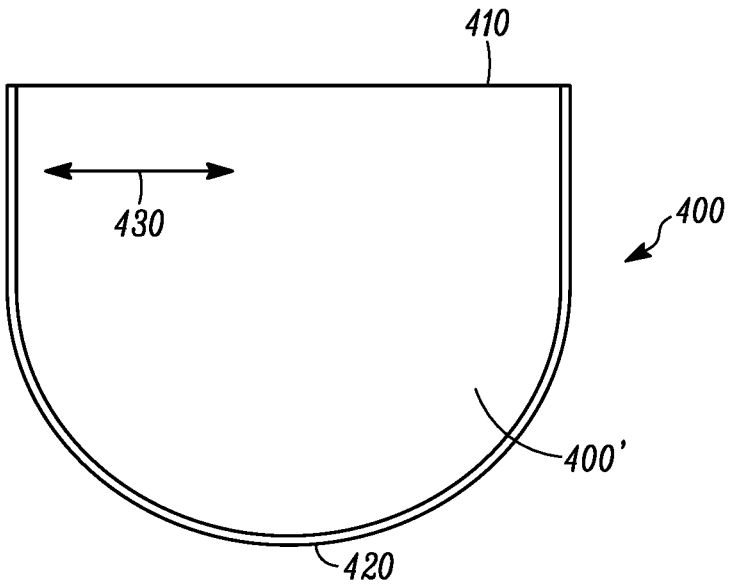
FIG. 4A is a view of a sack of the baby seat sack apparatus, according to an example embodiment.

FIG. 4A is a view of a sack pattern 400 of the baby seat sack apparatus 100, 101, according to an example embodiment. Shown in FIG. 4A, is the pattern for both the top portion and the bottom portion of the sack. The pattern 400 includes a straight end 410 which, when assembled, becomes the open end 114 of the sack 110. The pattern 400 includes sufficient seam allowance for the forming of the channel for the drawstring or cord, or for the elastic which can be sewn into the channel or which can be stretched and sewn directly to the finished straight edge 410. The pattern also includes a bottom 420. A curved portion of the bottom 420 results in the closed end 112 of the sack 100. The bottom 420 of the pattern 400 is C-shaped. The bottom edge includes a seam allowance. Fabric is cut using the pattern 400. The pattern 400 is used to cut the fabric to form two substantially identical pieces. The pattern 400 also includes an arrow 400 which is used to align the fabric to the bias direction of the fabric before cutting. Generally, the fabric is folded and the pattern is weighted or pinned to the folded fabric. Two pattern pieces are cut by cutting around the outline of the pattern 400. In one embodiment, the fabric is folded so that the two finished sides or two sides that will be on the exterior of the sack 110 abut one another. In this way, the need to cut markers in the fabric to aid in alignment are unnecessary. The fabric is already aligned and ready for sewing. The bottom 420 of the pattern is sewn with a seam allowance and turned inside out for further finishing. It should be noted that while sewing one piece to another piece, areas that may undergo high stress can be back-stitched to provide reinforcement. The seam near the straight end 410 would be reinforced as would the bottom of the c-shaped portion which will be repeatedly stretched over the frame.

Figure 4B:
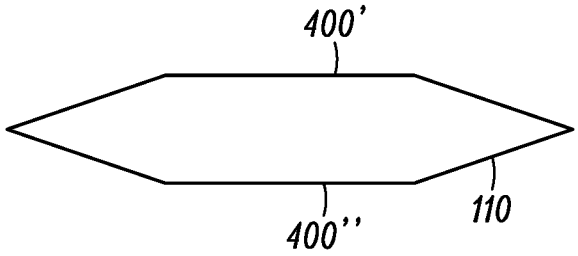
FIG. 4B is an end view of the baby seat sack apparatus, according to an example embodiment.

FIG. 4B is an end view of the baby seat sack apparatus 100, 101 after the two pieces 400' and 400" have been attached to one another and turned inside out to form the sack 110, according to an example embodiment. This view shows the dimensions which would accommodate most infant seats. Although the dimensions are shown, the invention is not limited to the dimensions set forth in the illustrations. It should also be noted, that the pieces do not necessarily need to be sewn. For example, a serger could be used rather than a sewing machine. A serger sews the two pieces together, cuts the excess cloth away and overcasts the material between the cut and the seam. In still other embodiments, the materials can be adhered or glued with appropriate adhesives. In still other embodiments, fabric may not be used. Plastics could be cut and formed into sacks and glued or thermally joined or ultrasonically joined to form the sack.

After forming the sack 110, the reinforcement strap 120 is formed and attached. Nylon webbing or a nylon strap is attached to the reinforcement strap 120 and buckles are sewn to the nylon webbing. Nylon webbing is also sewn or otherwise attached to the sack 110. The nylon webbing attached to the two sides of the sack 110 are threaded into the buckles. These can be used to snug or otherwise temporarily but securely attach the baby seat sack apparatus to an infant seat of any one of several devices. Stays can be inserted into pockets of the reinforcement strap 120.

Figure 5:
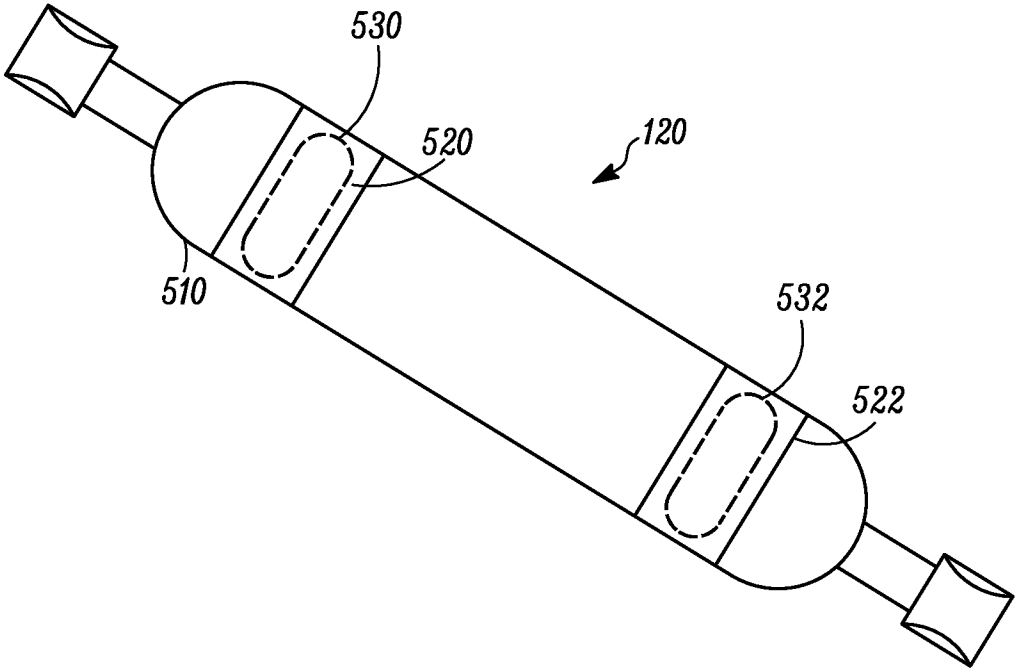
FIG. 5 is a schematic view of reinforcement strap, according to an example embodiment.

FIG. 5 is a schematic view of reinforcement strap, according to an example embodiment. The reinforcement strap 120 includes a widened portion 510 that is wider than the nylon webbing strap that attaches to the buckle or portion of the parachute buckle. On one side of the reinforcement strap 120, there is a first pocket 520 and a second pocket 522 that traverse the longitudinal length of the reinforcement strap 120. Stays 530 and 532 (shown in phantom) are inserted into the first pocket 520 and the second pocket 522. The stay is made of a material that is formable and malleable. The stay can be a metal or can be a plastic covered metal that resists fatigue failure from bending into various positions. The first pocket 520 and the second pocket 522 are sewn to the side of the strap 120 that interacts with the child seat or chair. This side may be referred to as a slip cover. In this way, the exterior portion of the strap 120 looks aesthetically pleasing. The stays hold the reinforcement strap 120 onto the frame of the child seat. This is a temporary hold that occurs before the parachute clips are engaged and tightened. The stays also prevent the strap from moving to a position off the frame. As shown in this embodiment, there are two stays. A wider stay that runs along the length of the reinforcement strap is also contemplated as part of the invention.

Figure 6:
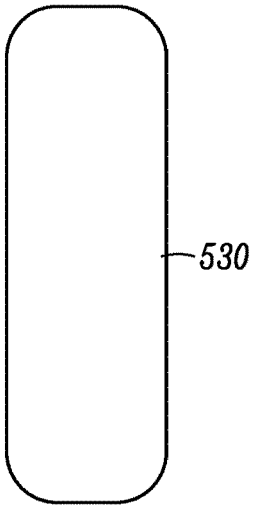
FIG. 6 is a schematic view of a stay that fits within the reinforcement strap, according to an example embodiment.

FIG. 6 is a schematic view of a stay, such as stay 530 that fits within the reinforcement strap 120, according to an example embodiment. The stay 530 has a sufficient width so that it can be formed around a frame portion of a child seat. The stay 530 is dimensioned so that it fits within the pocket 520 of the reinforcement strap. In some instances, the pocket 520 is dimensioned so that it fits around the stay 530. The stay 530 is not limited to a particular set of dimensions or to a certain aspect ratio. The important function of the stay is that at least one dimension will be of sufficient length to catch or capture a portion of the frame of the seat of the device.

Figure 7:
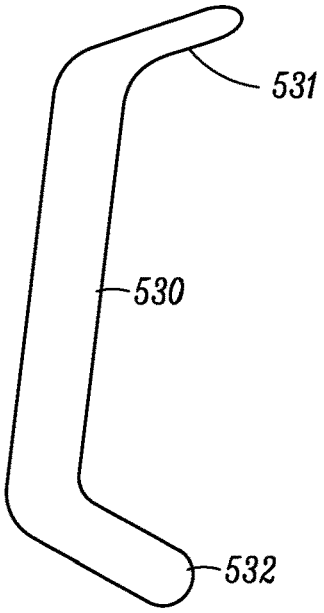
FIG. 7 is a schematic view of a stay that clips to a frame portion of the seat, according to an example embodiment.

FIG. 7 is a schematic view of a stay 530 that has been formed to clip to a frame portion of the seat, according to an example embodiment. The stay 530 may not be seen when in this form. This view might be of the stay 530 within the pocket 520 after it has been formed to clip to the frame. The stay 530 includes a first end 531 and a second end 532. The first end 531 and the second end 532 are formed so that the ends will capture or catch the frame portion of the seat. The dimension between the bends will be about the same dimension at the width of the frame of the child seat or the length of some feature of the child seat. The stay can be bent at any point along the length of the stay so that the stay 530 is adaptable and can capture or be held to any number of seats or features on seats.

Figure 8:
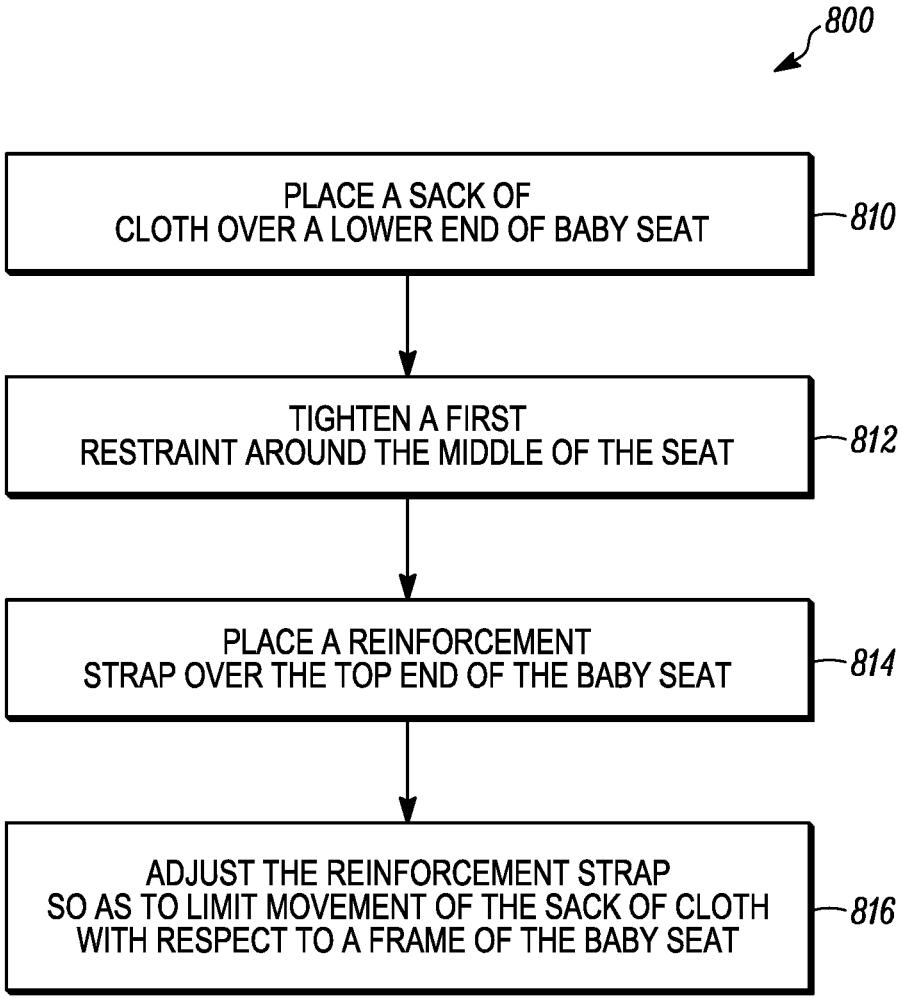
FIG. 8 is a flow chart of a method for using a baby seat sack, according to yet another example embodiment.

FIG. 8 is a flow chart of a method 800 for using a baby seat sack 100, 101, according to yet another example embodiment. The method 800 includes placing a sack of cloth over a lower end of a baby seat 810, tightening a first restraint around the middle of the seat 812, placing a reinforcement strap over the top end of the baby seat 814, and adjusting the reinforcement strap so as to limit movement of the sack of cloth with respect to a frame of the baby seat 816. Adjusting the reinforcement strap 816, in one embodiment, includes tightening a buckle associated with the reinforcement strap. The buckle can be a parachute type buckle that includes two side release portions. In one embodiment, the method of adjusting the reinforcement strap includes shaping a stay to a shape of the frame of the baby seat. In still another embodiment, the stay is shaped to a catch a portion of the frame of the baby seat.

Listed below is an example process for making a Baby Seat Sack, according to an example embodiment:

Manufacturing Instructions (2 Pieces):

In order to manufacture or produce The Baby Seat Sack, you will need to have the following Tools and Materials.

Tools:

Sewing Machine (I used a Brother XL 3750)
Fabric Scissors
Tin Snips
Sewing pins
Seam ripper Materials:

Stretch twill fabric (20"×50" with stretch going parallel with 50" edge) Made of 4% spandex, 61% Rayon, 35% nylon
24" of 1" nylon strap, Made of 100% polyester
36" of ¼" double fold bias tape
2 parachute buckle fasteners. Made of bio-synthetic plastic
65" of nylon paracord
Scotch tape and Electrical tape
1 Cord Stopper. Made of bio-synthetic plastic
Sewing thread
9" of ¾"×0.031" and 304 Grade stainless steel plumbers tape Manufacturing Part One of the Baby Seat Sack 1. Cut two half egg shapes of stretched twill fabric, 21" across at the top and 16½" tall. (Part A in Drawings) *Note that the stretch in the fabric needs to run parallel with the straight edge of the cut.
2. Match the two egg shapes of stretched twill fabric and pin the parameter.
3. Sew a stretched stitch (upper tension setting 4, stitch width setting 4) along the curvature of the half egg one half inch in from fabric cut, this will create an expandable pocket 20" wide and 16" tall.
4. Double fold 1" wide (2" total fold) section at the top of the half egg pocket perimeter and sew a stretched stitch at the bottom of the double fold, for a finished product height of 14".
5. Turn pocket inside out for all seams are inside.
6. With a seam ripper, cut a half inch slit on the far right side at the seam ¼" from the top of the opening of the pocket.
7. Cut 65" of nylon paracord, and wrap both ends tightly with scotch tape. *May insert safety pin on one end of paracord for ease to pull through in next step.
8. Feed the nylon paracord along the top inseam of the egg pocket perimeter through the half inch slit cut with the seam ripper. *Note that the paracord ends will start and stop at this slit, sticking out evenly.
9. Install cord stopper on even ends of paracord cables and tie off with a simple knot.
10. Cut two pieces of 1" nylon strap 12" long,
11. Double fold one end of nylon strap ½" and sew with a straight stitch (stitch width 3, upper tension 3, stitch length 3, pattern selection #2) the perimeter of the fold. (Repeat this on second piece of nylon strap).
12. Obtain male ends of the parachute buckle fasteners.
13. Insert open end of nylon strap through male parachute buckle fastener, and then bring open end of nylon strap back through male parachute buckle fastener with male end pointing away from square stitch folded end, to form an adjustable male buckle. (Repeat this on second piece of nylon strap)
14. Measuring 2" in from the top of the half egg pocket side seam, align open end bottom of nylon strap with draw string stitch, and sew securely along existing stitch, and ¼" from top of half egg pocket. *Note to not to interrupt nylon paracord drawstring tubing. (Repeat this on second piece of nylon strap from other side of the top of the half egg pocket side seam)
15. This will create and end measurement of 10" adjustable nylon straps on both sides of your baby seat sack.
16. Production of part one of The Baby Seat Sack is complete.

Manufacturing Part Two of the Baby Seat Sack

1. Cut an 28" width×3½" height piece of stretched twill fabric, that will enable the integrity of the stretch to be on the 3½" measurement of the fabric, this will be called the strap. 5" in from both ends of the strap length, taper down to a point. (Part B on Drawings)
2. Cut three 3½" height×1" width pieces of stretched twill fabric that will enable the integrity of the stretch to be on the 3½" measurement of the fabric. These will be called fabric rectangles.
3. Measuring the strap from left to right, sew with a straight stitch (stitch width 3, upper tension 3, stitch length 3, pattern selection #2) one fabric rectangle on three sides (leaving one of the width sides open) centered at 5½", 9", and 12½" respectively. This will form a pocket.
4. With your tin snips, cut three 3" pieces of stainless steel plumbers tape and wrap completely with electrical tape two times vertically. These will be called metal bindings.
5. Insert one metal binding into each fabric rectangle pocket.
6. Cut two 20" pieces of ¼" double folded bias tape.
7. Sew with a zig-zag stitch (stitch width 3, upper tension 3, stitch length 3, pattern selection 3) your ¼" double folded bias tape on both edges of the strap width to each point. Trim excess tape. *Note that this will close the fabric rectangle pocket securing the metal bindings inside.
8. Obtain male ends of the parachute buckle fasteners.
9. Take one female end of the parachute buckle fastener and insert one end of the strap points through, to loop around and stitch with same zig-zag stitch setting in step 7. *Note to pull strap point end through fastener until fabric equals the width of the fastener. Stitch side should be on same side of the fabric rectangle pockets; this will seal the fastener in permanently.
10. Repeat this step with the other female end of the parachute strap and parachute buckle fastener so that the strap has one male end on each side.
11. Production of part two of The Baby Seat Sack is complete.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. It will be apparent to one of ordinary skill in the art that many modifications and variations are possible in view of the above teachings.

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

While the embodiments have been described in terms of several particular embodiments, there are alterations, permutations, and equivalents, which fall within the scope of these general concepts. It should also be noted that there are many alternative ways of implementing the methods and apparatuses of the present embodiments. It is therefore intended that the following appended claims be interpreted as including all such alterations, permutations, and equivalents as fall within the true spirit and scope of the described embodiments.

What is claimed:

1. A baby seat sack apparatus comprising:

a sack sized to fit over one end of a baby seat apparatus, the baby seat sized and adapted to hold an infant baby within the seat, the sack including a closed end;

an open end sized to fit over the one end of the baby seat;

a draw cord positioned around the open end of the sack and to secure the sack around a portion of the baby seat between the one end of the baby seat and an other end of the baby seat; and a cord lock fitted to the draw cord for holding the draw cord in a drawn position tight to the portion of the baby seat between the one end of the baby seat and the other end of the baby seat; and a reinforcement strap attached to the open end of the sack, the reinforcement strap fitting around the other end of the baby seat apparatus to limit movement of the sack with respect to the baby seat.

2. The baby seat sack apparatus of claim 1 wherein the reinforcement strap is adjustable to a position where the reinforcement strap substantially prevents movement of the baby seat sack apparatus with respect to the length of the baby seat.

3. The baby seat sack apparatus of claim 1 wherein the reinforcement strap is adjustable to a position where the reinforcement strap substantially prevents movement of the baby seat sack apparatus with respect to a frame of the baby seat, the reinforcement strap including at least one buckle fastener.

4. The baby seat sack apparatus of claim 1 wherein the reinforcement strap is adjustable to a position where the reinforcement strap substantially prevents movement of the baby seat sack apparatus with respect to a frame of the baby seat, the reinforcement strap including at least one parachute buckle fastener.

5. The baby seat sack apparatus of claim 1 wherein the reinforcement strap is adjustable to a position where the reinforcement strap substantially prevents movement of the baby seat sack apparatus with respect to a frame of the baby seat, the reinforcement strap also including at least one formable stay to allow the strap to be formed to the frame of the seat.

6. The baby seat sack apparatus of claim 5 wherein the reinforcement strap is adjustable to a position where the reinforcement strap substantially prevents movement of the baby seat sack apparatus with respect to a frame of the baby seat, wherein the formable stay is made of metal.

7. The baby seat sack apparatus of claim 1 wherein the sack is made of material which is stretchable in a first direction and substantially unstretchable in a second direction which is substantially perpendicular to the first direction.

8. The baby seat sack apparatus of claim 1 wherein the sack is made of material which is stretchable in a first direction and substantially unstretchable in a second direction which is substantially perpendicular to the first direction, the sack formed so that the material is oriented so the stretchable direction is substantially parallel to the open end of the sack.

9. The baby seat sack apparatus of claim 1 where the sack portion of the baby seat sack apparatus has a substantially equal width along the length of the baby seat sack apparatus.

10. A baby seat sack apparatus comprising:

a sack sized to fit over one end of a baby seat apparatus adapted and sized for seating an infant, the sack including a closed end covering a portion of the baby seat and adapted to enclose a lower portion of the baby seat while leaving an upper portion uncovered;

an open end sized to receive the one end of the baby seat and fitting around a middle portion of the baby seat, between the one end of the seat and an other end of the seat;

an elastic cord member positioned near the open end of the sack, the elastic member sized to at least circumscribe the width of the middle portion of the baby seat; and a reinforcement strap attached to the sack, the reinforcement strap fitting over at least a portion of the other end of the baby seat apparatus, the reinforcement strap positioned to attach to a frame of the baby seat while leaving the upper portion of the baby seat apparatus uncovered.

11. The baby seat sack apparatus of claim 10 wherein the reinforcement strap is adjustable to a position where the reinforcement strap substantially prevents movement of the baby seat sack apparatus with respect to the frame of the baby seat.

12. The baby seat sack apparatus of claim 10 wherein the reinforcement strap is adjustable to a position where the reinforcement strap substantially prevents movement of the baby seat sack apparatus with respect to the frame of the baby seat, the reinforcement strap including at least one buckle fastener.

13. The baby seat sack apparatus of claim 10 wherein the reinforcement strap is adjustable to a position where the reinforcement strap substantially prevents movement of the baby seat sack apparatus with respect to the frame of the seat, the reinforcement strap including at least one parachute buckle fastener.

14. The baby seat sack apparatus of claim 10 wherein the reinforcement strap is adjustable to a position where the reinforcement strap substantially prevents movement of the baby seat sack apparatus with respect to the frame of the seat, the reinforcement strap also including at least one formable stay to allow the strap to be formed to the frame of the baby seat.

15. The baby seat sack apparatus of claim 14 wherein the reinforcement strap is adjustable to a position where the reinforcement strap substantially prevents movement of the baby seat sack apparatus with respect to the frame of the baby seat, wherein the formable stay is made of metal.

16. The baby seat sack apparatus of claim 10 wherein the sack is made of material which is stretchable in a first direction and substantially unstretchable in a second direction which is substantially perpendicular to the first direction.

17. The baby seat sack apparatus of claim 10 wherein the sack is made of material which is stretchable in a first direction and substantially unstretchable in a second direction which is substantially perpendicular to the first direction, the sack formed so that the material is oriented so the stretchable direction is substantially parallel to the open end of the sack.

18. The baby seat sack apparatus of claim 10 where the sack portion of the baby seat sack apparatus has a substantially equal width along the length of the baby seat sack apparatus.

19. A baby seat sack apparatus comprising:

a sack sized to fit over one end of a baby seat apparatus while leaving the other end of the baby seat apparatus substantially open, the baby seat adapted to fit an infant therein, the sack including a closed end;

an open end sized to receive the one end of the baby seat;

a draw cord positioned around the open end of the sack and to secure the sack to a middle portion of the baby seat apparatus; and a cord lock for holding the draw cord in a drawn position; and a reinforcement strap attached to the sack, the reinforcement strap fitting over the other end of the baby seat apparatus.

20. The baby seat sack apparatus of claim 19 where the sack portion of the baby seat sack apparatus has a substantially equal width along the length of the baby seat sack apparatus.

* * * * *